US006701839B1

(12) United States Patent
Levy

(10) Patent No.: US 6,701,839 B1
(45) Date of Patent: Mar. 9, 2004

(54) FLUID METERING ROLL WITH RASTER LINE INTERRUPTIONS

(75) Inventor: Michel Levy, Esch-sur-Alzette (LU)

(73) Assignee: Cabinet Cabinet Erman Sarl, Luxembourg (LU)

( * ) Notice: Subject to any disclaimer, the term of this patent is extended or adjusted under 35 U.S.C. 154(b) by 0 days.

(21) Appl. No.: 10/111,891

(22) PCT Filed: Oct. 24, 2000

(86) PCT No.: PCT/EP00/10474

§ 371 (c)(1),
(2), (4) Date: Apr. 26, 2002

(87) PCT Pub. No.: WO01/32422

PCT Pub. Date: May 10, 2001

(30) Foreign Application Priority Data

Oct. 29, 1999 (LU) ..... 90470

(51) Int. Cl.[7] ..... B41F 9/06; B41F 31/07
(52) U.S. Cl. ..... 101/352.13; 101/153
(58) Field of Search ..... 101/150, 153, 101/170, 154, 348, 349.1, 350.6, 352.11, 352.13; 492/30, 31

(56) References Cited

U.S. PATENT DOCUMENTS

| | | | | | |
|---|---|---|---|---|---|
| 2,273,967 | A | | 2/1942 | Leech | |
| 3,980,018 | A | | 9/1976 | Ichikawa | |
| 4,155,766 | A | * | 5/1979 | Hieber et al. | 101/150 |
| 4,200,044 | A | * | 4/1980 | Vested | 101/170 |
| 4,301,583 | A | * | 11/1981 | Poole | 492/35 |
| 4,819,558 | A | * | 4/1989 | Counard | 101/348 |
| 4,939,994 | A | * | 7/1990 | Puleston | 101/348 |
| 5,033,377 | A | * | 7/1991 | Shimizu | 101/150 |
| 5,671,678 | A | * | 9/1997 | Bolte et al. | 101/491 |

* cited by examiner

*Primary Examiner*—Andrew H. Hirshfeld
*Assistant Examiner*—Leo T. Hinze
(74) *Attorney, Agent, or Firm*—Andrus, Sceales, Starke & Sawall, LLP

(57) ABSTRACT

A printing tool comprising a raster formed of a grid of intersecting raster lines which raster lines form raster points between them. The raster comprises at least one region in which each raster point is connected to at least one other raster point adjacent via an interruption in the raster line separating the raster points.

19 Claims, 3 Drawing Sheets

FLUID METERING ROLL WITH RASTER LINE INTERRUPTIONS

CROSS REFERENCE TO RELATED APPLICATION

The present application is the U.S. national stage application of International Application PCT/EP00/10474, filed Oct. 24, 2000, which international application was published on May 10, 2001 as International Publication WO 01/32422. The International Application claims priority of Luxembourg Patent Application 90470, filed Oct. 29, 1999.

The present invention relates to a printing tool which comprises a raster formed of a grid of intersecting raster lines, which raster lines form raster points between each other.

Photogravure or heliogravure printing has been known since the 19th century. With the passage of time, a certain number of improvements were made to it. A printing tool, in general a printing cylinder, is provided with a fine grid which is still referred to as a raster. This raster serves both as an ink reservoir and as a support for a scraper. The raster consists of intersecting raster lines forming raster points between each other. Prior to printing, the raster points are filled with ink and a scraper passes over the raster to remove the ink surplus. During the printing, a support, in most cases paper, touches the raster and the ink located in the raster points is deposited onto the paper. This printing method enables printing to be carried out with rather good quality. Nevertheless, the locations where the paper rests on the raster lines during the printing are not printed on and will appear as a very fine grid on the paper.

In order to remedy this problem, ink which may diffuse on the paper is chosen. During the dot gain (point gain) as a result of ink diffusion, the ink deposited on the paper spreads and covers the raster lines, thus making the fine grid disappear. Even if the dot gain succeeds in spreading out the ink onto the parts not printed on, this spreading is not uniform and can not be controlled, so to speak. As a result, the printed surface will exhibit spurious patterns harming the uniformity of the print. The raster lines still remain visible; the printing is said to be "sprinkled" and all the borderlines of the printed regions have indentations which correspond to the remainders of the regions without ink from the raster. Positive texts are fattened, as "flow-on painted", and resist-type texts in the flat parts are thinned down, as "overcast or cloudy".

BRIEF DESCRIPTION OF THE INVENTION

According to the invention, this object is achieved by a printing tool according to claim 1.

Such tool comprises a raster formed of a grid of intersecting rasterlines with the raster lines forming raster points between them. According to an important aspect of the invention, the raster comprises at least one printing region where each raster point is connected to at least one other raster point adjacent via one interruption in the raster line separating the raster points.

Due to the interruption in the raster line, the total surface of the raster lines is reduced. The amount of ink directly deposited onto a support is larger. As a result, the surface to be covered with ink by means of ink diffusion on the paper, i.e. by the dot gain, is reduced. A better printing quality is thus obtained. The printed surfaces are more uniform and are basically free of raster line traces. The surface of the flat regions no longer exhibits spurious patterns harming the uniformity of the flat regions. The typeface of the positive characters remains clearly visible and the negative resist-type characters in the flat regions become less and even not at all overcast/cloudy.

The tool according to the present invention thus comprises a raster with which the dot gain can be reduced, thus improving the quality of the printing. At the same time, the raster is still able to hold a scraper.

According to a preferred embodiment, the interruption in the raster line is chevron-shaped (in a herringbone pattern). Advantageously, the chevrons form an angle between 15 and 135 degrees, preferably 45 degrees.

Advantageously, they have teeth having a length of between 60 and 350 $\mu$m, preferably 140 $\mu$m. Advantageously, they have a width of between 5 and 50 $\mu$m, preferably 10 $\mu$m. As a result, the raster still has enough strength for holding the scraper.

Preferably, the raster points have the shape of a truncated pyramid.

Preferably, the raster points are lozenge-shaped in section with the diagonals having a ratio of between 0.3 and 2.0, preferably 0.5.

Advantageously, the raster lines have a line density of between 25 and 350 lines per cm, preferably between 70 and 140 lines per cm. This line density of the raster lines ensures a good resolution of the printing.

According to a preferred embodiment, at least a part of the raster points is connected to two adjacent raster points. The total surface of the raster lines and thus the dot gain are further reduced and the quality of the printing is therefore improved.

According to another preferred embodiment, at least a part of the raster points is connected to three adjacent raster points. The total surface of the raster lines and thus the dot gain are further reduced and the quality of the printing is therefore improved.

According to yet another preferred embodiment, at least a part of the raster points is connected to all adjacent raster points. The total surface of the raster lines and thus the dot gain are further reduced and the quality of the printing is therefore improved.

Of course, it is possible to implement regions, on a single printing support, in which a given number of raster points are connected to an adjacent raster point, and even to two, three or four adjacent raster points. Also, part of the printing support may be fabricated in the conventional manner, i.e. without the raster points being connected to adjacent raster points, without the raster lines being interrupted. The skilled person will choose the number of interconnected raster points as a function of the printing to be carried out.

According to a preferred embodiment, the printing tool comprises at least one printing region delimited by a peripheral groove. Using the Béziers curves, a peripheral groove which exactly draws the contour of the printing region can be obtained. When the pictures available for the printing are not advantageously vectorized, it is possible to determine the border lines of the regions to be surrounded by a peripheral groove by creating isodensity curves, to provide these curves with thickness and to give them a thickening direction.

The peripheral groove eliminates the presence of raster lines at the border of the printing region, forms a wall of ink which dries more rapidly than that of the flat region and, therefore, limits the dot gain, limits changes in the fattening of the letters and fine graphical features and, therefore, ensures that the border of the printed region on the support is sharp and continuous, i.e. without any indentation.

It is advantageous to modify the size of the printing region such that after the ink is printed onto the support, the groove is positioned for obtaining a printed surface of desired size.

The printing region for a positively printed surface is preferably thinned down such that after diffusion of the ink on the support a printed surface of desired size is obtained. In other words, the peripheral groove is placed in a retracted position with respect to its theoretical position, i.e. with respect to the position where it would have been placed if the dot gain phenomenon had not been taken into account.

The printing region for a negatively printed surface is preferably thickened such that after diffusion of the ink on the support a printed surface of desired size is obtained. Consequently, the peripheral groove is placed with respect to its theoretical position in order to anticipate the rheological movements of the ink.

Preferably, the peripheral groove is placed onto the borderline of the printing region with a shift equal in value to the dot gain. Preferably, the peripheral groove has a thickness of between 10 and 600 $\mu$m, preferably 30 $\mu$m for printing on smooth supports such as polypropylene and 45 $\mu$m for printing on supports such as magazine-type coated paper.

According to an embodiment, the peripheral groove comprises a spreading net between the peripheral groove and the raster points. The dot gain effect which fattens the raster points on the support by diffusion of the printed ink also fattens the peripheral groove. The spreading net enables the ink of the peripheral groove and of the adjacent raster points to diffuse in the surface corresponding to the spreading net. Due to the spreading net, the contour of the printed surface is continuous even after diffusion of the ink on the support.

Advantageously, the spreading net has a thickness of between 0 and 600 $\mu$m, preferably equal to the thickness of the contiguous raster lines.

BRIEF DESCRIPTION OF THE DRAWING

Further particular features of the invention will become apparent from the detailed description of an advantageous embodiment shown below for the sake of illustration and with reference to the annexed drawings in which.

DETAILED DESCRIPTION OF THE INVENTION

Figure 1:
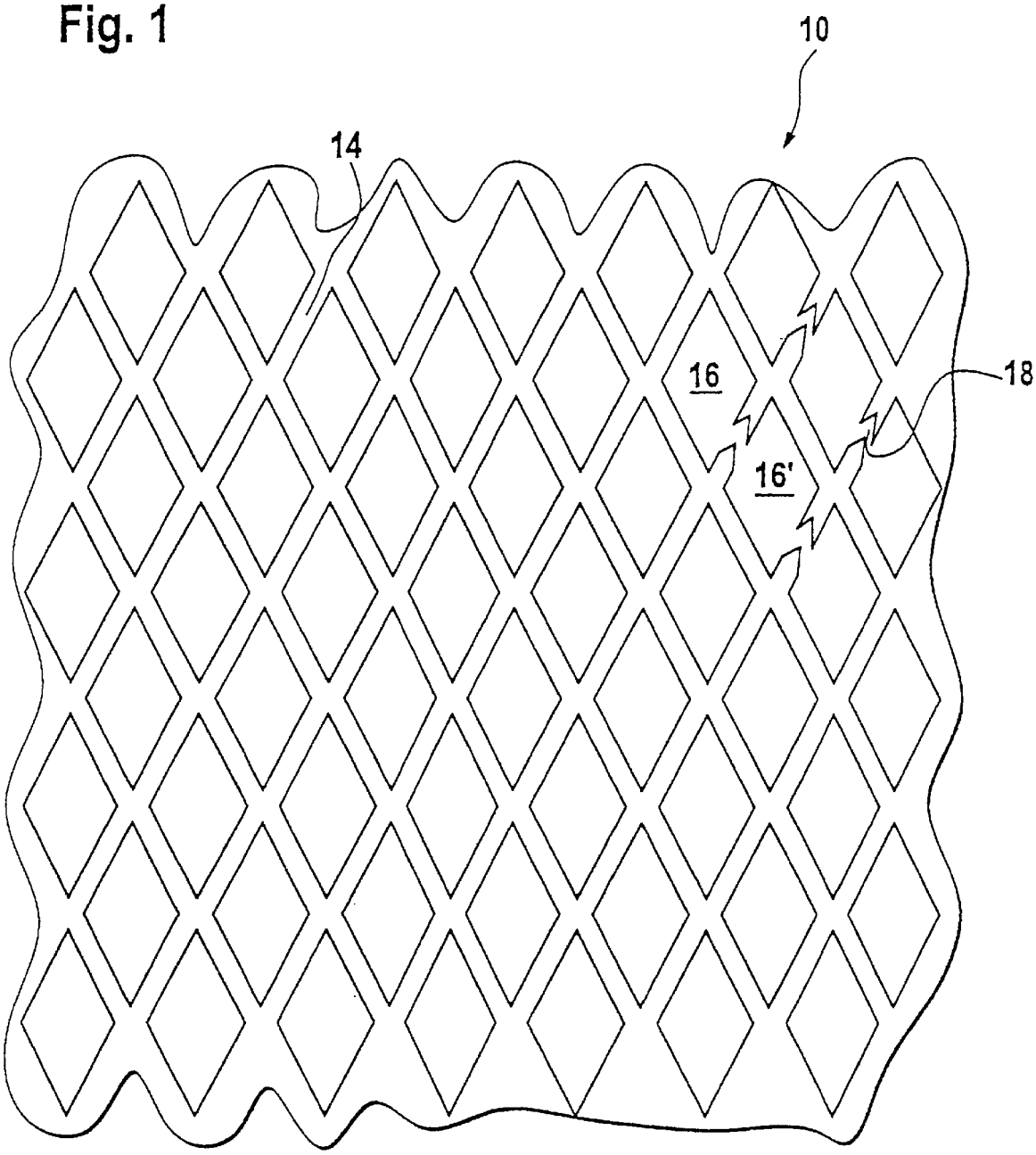
FIG. 1 is a schematic view of a raster.

Referring to FIG. 1, a raster 10 comprising raster lines 14 is shown. The raster lines 14 intersect and form raster points 16 among themselves. The raster points 16 are lozenge-shaped with a diagonal ratio equal to 0.5.

Figure 2:
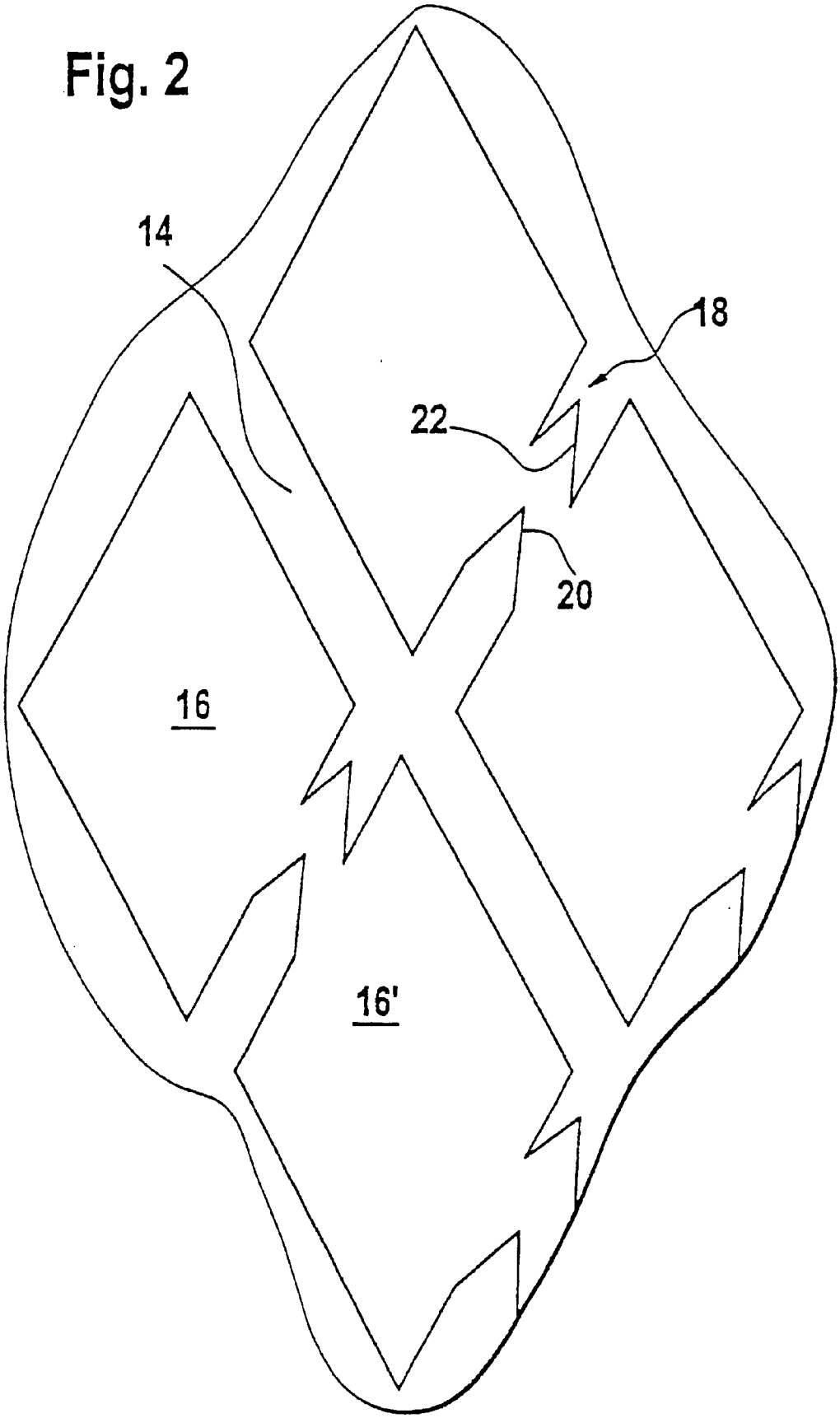
FIG. 2 is a schematic view of several raster points with interruptions in the raster lines.

In the raster lines 14 interruptions 18 are formed which link two adjacent raster points 16, 16'. These interruptions 18 are more clearly illustrated in FIG. 2. The interruptions 18 are chevron-shaped (in a herringbone pattern) having two teeth 20, 22. The two teeth 20, 22 form a 45 degree angle between them and have a length of about 140 $\mu$m and a thickness of about 10 $\mu$m.

Figure 3:
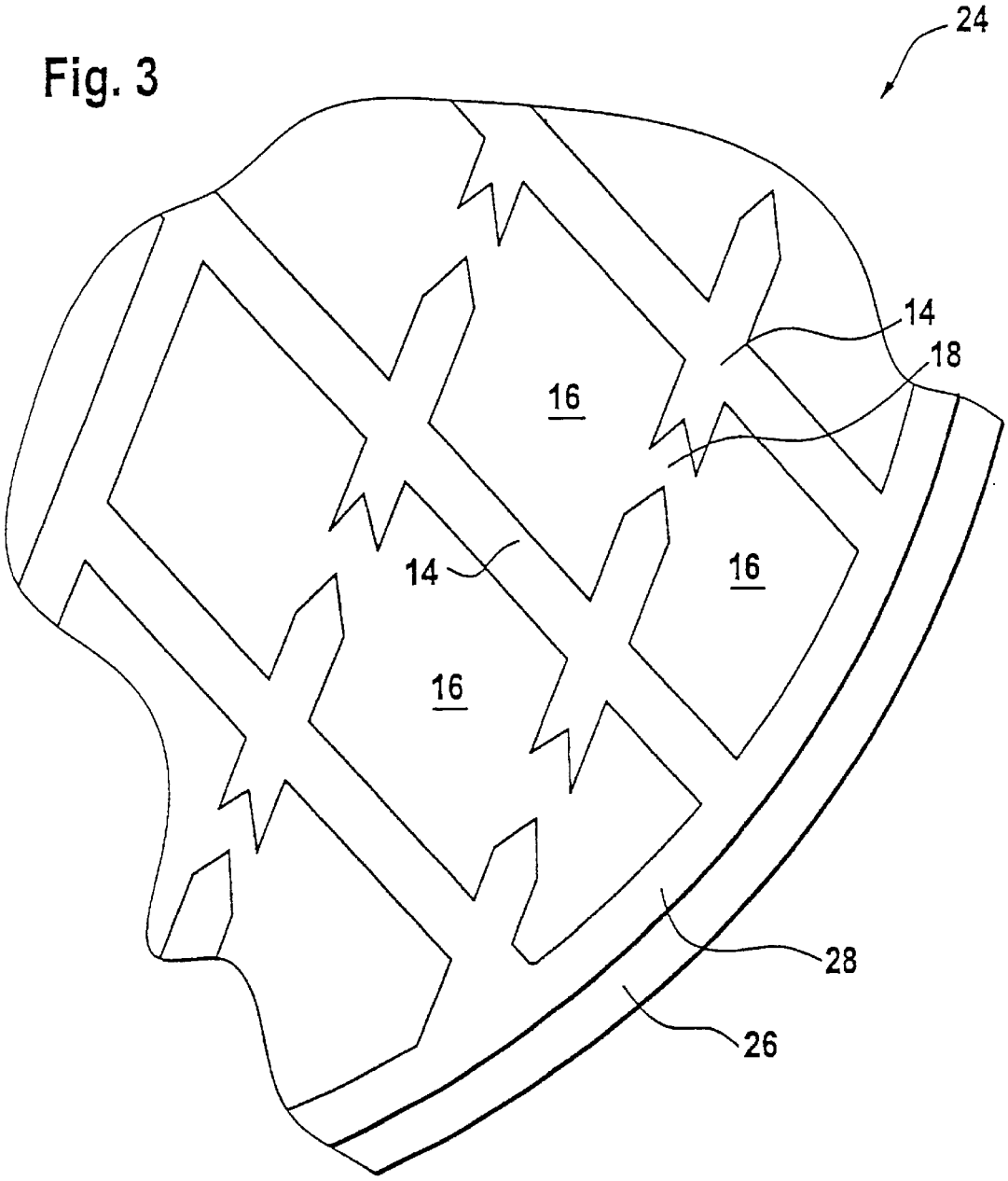
FIG. 3 is a schematic view of the border of a raster.

Referring to FIG. 3, a printing region 24 comprising a raster 10 delimited by a peripheral groove 26 is shown. Between the peripheral groove 26 and the raster 10 a spacer net 28 is arranged.

In order to carry out a printing, the raster points and the peripheral groove are filled with ink. An ink surplus is removed using a scraper which is held by the raster lines. The raster forms a rigid support for the paper which is directly placed onto the raster during the printing. The ink contained in the raster points and the peripheral groove is transmitted to the paper. At the locations where an ink deposit is not possible because of the raster lines, printing nevertheless takes place by diffusion of the ink on the paper. This diffusion allows the ink to spread out, thus covering the locations opposite the raster lines.

In order to achieve a continuous and primarily a uniform flat region, the rheological characteristics of the ink are chosen such that the dot gain is equal to half the thickness of the raster lines.

Due to the interruptions in the raster lines, the total surface of the tool covered by raster lines is diminished. As a result, ink diffusion control is facilitated and there is clearly less surface to be "printed" by diffusion. Therefore, a uniform printed surface without strokes is achieved.

What is claimed is:

1. A printing tool comprising a raster formed of a grid of intersecting raster lines, said raster lines forming raster points between them, wherein the raster comprises at least one printing region where each raster point is connected to at least one other raster point adjacent via an interruption in the raster line separating said raster points and wherein at least one printing region is delimited by a peripheral groove.

2. The tool according to claim 1, wherein the interruption in the raster line is chevron-shaped.

3. The tool according to claim 2, wherein the chevron shaped interruptions have teeth forming an inner angle between 15 and 135 degrees.

4. The tool according to claim 2, wherein the chevron shaped interruptions have teeth having a length of between 60 and 350 $\mu$m, measured along a line parallel to the raster line.

5. The tool according to claim 2, wherein the chevron shaped interruptions have a width of between 5 and 50 $\mu$m, measured perpendicular to the raster line.

6. The tool according to claim 1, wherein the raster comprises at least one printing region in which the raster points have the shape of a truncated pyramid.

7. The tool according to claim 6, wherein the raster comprises at least one printing region in which the raster points are lozenge-shaped in section.

8. The tool according to claim 7, wherein the diagonals of the lozenge-shape raster points have a ratio of between 0.3 and 2.0.

9. The tool according to claim 1, wherein the raster comprises at least one printing region in which the raster lines have a line density of between 25 and 350 lines per cm.

10. The tool according to claim 1, wherein the raster comprises at least one printing region in which the raster lines have a line density of between 70 and 140 lines per cm.

11. The tool according to claim 1, wherein the raster comprises at least one printing region in which each raster point is connected to two adjacent raster points.

12. The tool according to claim 1, wherein the raster comprises at least one printing region in which each raster point is connected to three adjacent raster points.

13. The tool according to claim 1, wherein the raster comprises at least one printing region in which each raster point is connected to all adjacent raster points.

14. The tool according to claim 1, wherein the peripheral groove is placed on the borderline of the printing region with a shift equal in value to the dot gain.

15. The tool according to claim 1, wherein the peripheral groove has a thickness of between 10 and 600 $\mu$m.

16. The tool according to claim 15, wherein the peripheral groove has a thickness of 30 $\mu$m.

17. The tool according to claim 1, wherein a spreading net is provided between the peripheral groove and the raster points.

18. The tool according to claim 17, wherein the spreading net has a thickness of between 0 and 600 $\mu$m.

19. The tool according to claim 17, wherein the spreading net has a thickness equal to the thickness of raster lines contiguous to said spreading net.

* * * * *